US009651201B2

(12) United States Patent
Lin et al.

(10) Patent No.: US 9,651,201 B2
(45) Date of Patent: May 16, 2017

(54) RETRACTABLE END-CAP FOR LED TUBE

(71) Applicant: Lightel Technologies, Inc., Renton, WA (US)

(72) Inventors: Ching-Feng Lin, Taipei (TW); Pai-Sheng Shen, Bellevue, WA (US)

(73) Assignee: LIGHTEL TECHNOLOGIES, INC., Renton, WA (US)

( * ) Notice: Subject to any disclaimer, the term of this patent is extended or adjusted under 35 U.S.C. 154(b) by 237 days.

(21) Appl. No.: 14/670,382

(22) Filed: Mar. 26, 2015

(65) Prior Publication Data

US 2015/0198291 A1 Jul. 16, 2015

Related U.S. Application Data

(63) Continuation-in-part of application No. 14/135,319, filed on Dec. 19, 2013, now Pat. No. 9,206,949.

(51) Int. Cl.

| | |
|---|---|
| ***F21V 25/04*** | (2006.01) |
| ***H01R 33/96*** | (2006.01) |
| ***F21K 99/00*** | (2016.01) |
| ***H01R 33/08*** | (2006.01) |
| ***F21K 9/27*** | (2016.01) |
| *F21Y 101/00* | (2016.01) |

(52) U.S. Cl.

CPC ..... *F21K 9/175* (2013.01); *F21K 9/27* (2016.08); *F21V 25/04* (2013.01); *H01R 33/0836* (2013.01); *H01R 33/96* (2013.01); *F21Y 2101/00* (2013.01)

(58) Field of Classification Search

CPC ..... H01R 33/96; F21V 25/04

See application file for complete search history.

(56) References Cited

U.S. PATENT DOCUMENTS

| | | | | |
|---|---|---|---|---|
| 5,412,550 A * | 5/1995 | Hsieh | F21S 8/035 | 362/641 |
| 8,523,394 B2 * | 9/2013 | Simon | F21V 25/04 | 362/249.05 |
| 8,894,430 B2 * | 11/2014 | Simon | F21V 25/04 | 439/226 |
| 2010/0181178 A1 * | 7/2010 | Chang | F21V 19/008 | 200/341 |
| 2012/0043892 A1 * | 2/2012 | Visser | F21V 25/04 | 315/121 |

(Continued)

*Primary Examiner* — Andrew Coughlin
*Assistant Examiner* — Zachary J Snyder
(74) *Attorney, Agent, or Firm* — Han IP Corporation; Andy M. Han

(57) ABSTRACT

Embodiments of an end-cap for an LED tube are described. In one aspect, an end-cap for an LED tube may include an end-cap housing, an elastic component, a power connector, and a movable assembly. The movable assembly may include a power pin thereon and configured to connect to an external power source. The elastic component may reside inside the end-cap housing. A first end of the movable assembly may connect to the end-cap housing. A second end of the connecting assembly opposite to the first end thereof may connect to a body of the LED tube through the power connector. The power connector may be electrically disconnected from the power pin when the end-cap housing is pressed. The power connector may be electrically connected to the power pin when the end-cap housing is not pressed.

10 Claims, 8 Drawing Sheets

(56) References Cited

U.S. PATENT DOCUMENTS

| | | | | |
|---|---|---|---|---|
| 2012/0155074 | A1* | 6/2012 | Mori | F21V 23/06 362/221 |
| 2012/0235556 | A1* | 9/2012 | Wu | F21V 23/04 313/483 |
| 2012/0300445 | A1* | 11/2012 | Chu | F21V 25/04 362/217.13 |
| 2013/0127327 | A1* | 5/2013 | Heil | F21V 25/04 313/313 |
| 2014/0009925 | A1* | 1/2014 | Verhoeven | F21V 19/008 362/221 |

* cited by examiner

RETRACTABLE END-CAP FOR LED TUBE

CROSS REFERENCE TO RELATED PATENT APPLICATION

The present disclosure is a continuation-in-part (CIP) application of U.S. patent application Ser. No. 14/135,319, filed on Dec. 19, 2013, which claims the priority benefit of Chinese Patent Application No. 201310636570.5 filed on Nov. 27, 2013 with the State Intellectual Property Office of China. The above-identified patent applications are incorporate by reference in their entirety.

TECHNICAL FIELD

The present disclosure relates to the field of luminaires and, more particularly, to a retractable end-cap of a lighting tube.

BACKGROUND

When a fluorescent tube lamp in a linear lighting fixture is retrofitted with a light-emitting diode (LED) tube, line voltage of 120V or 277V or higher is applied directly to the lamp-holders of the fixture and to the end-caps of the LED tube. If the LED tube employs double-end wiring, when one end of the LED tube connects with the power source, the other end of the LED tube instantly becomes live with electricity. This represents an electrical shock hazard for the installer of the LED tube.

One approach provides an LED tube wherein each of the two end-caps of the LED tube contains an extruded, spring-based safety switch. Before installation, the safety switch is not engaged and thus the bi-pins on the end-cap remain disconnected from the internal electric circuit of the LED tube. During installation, when one end-cap of the LED tube is inserted into the lamp-holder of a linear fixture, the external power source connects to the bi-pins on the end-cap, and at the same time the safety switch is pressed, thus connecting the bi-pins on the end-cap to the internal electric circuit of the LED tube. However, since the bi-pins of the remaining end-cap of the LED tube have not yet been inserted into the other lamp-holder on the linear fixture, the remaining safety switch is not engaged and therefore the remaining end-cap remains disconnected from both the external power source and the internal electric circuit of the LED tube. At this time, the installer can still safely touch the bi-pins of the disconnected end-cap with their bare hands without any risk of electrical shock. There are, however, two drawbacks with the inventive concept of the present disclosure. Firstly, when the lamp-holder loosens over time, the extruded, spring-based safety switch on the end-cap may not be properly engaged to connect the bi-pins to the internal circuit when the LED tube is installed into a linear fixture, resulting in poor connection between the LED tube and the external power source. Secondly, the length of the linear fixture varies. If an LED tube with the extruded, spring-based safety switch is inserted into a linear fixture that is slightly too long, the extruded, spring-based safety switch on the end-cap may not be properly engaged to connect the bi-pins to the internal circuit, resulting in poor connection between the LED tube and the external power source. If the linear fixture is shorter than the LED tube, it is not possible to insert the LED tube into the fixture.

Another approach provides an LED tube where a spring-based, floating end-cap is used on the LED tube. The bi-pins of the end-cap connect to the internal circuit of the LED tube. Before installation, the bi-pins are hidden inside the floating end-cap, and thus there is no risk of the installer making contact with the bi-pins. When the tube is inserted into a linear fixture, the spring-based, floating end-cap is pressed and retracts towards the center of the tube, thus exposing and enabling the bi-pins to connect to the external power source. This second approach solves the problem with the extruded, spring-based safety switch disclosed in the first approach mentioned above, where poor connection arises due to a loosened lamp-holder. However, this spring-based, floating end-cap design still does not solve the problem of differences in the length of the linear fixture, given the fact that the length of the LED tube with the floating end-caps is fixed. Moreover, the floating end-caps present another challenge; namely, the installer cannot see the bi-pins during installation because they are hidden inside the end-cap until the end-cap is pressed. As such, the installer needs to press both end-caps at the same time during installation to expose and insert the bi-pins into the lamp-holders. This is a very difficult task to perform when installing a 4-ft or 5-ft LED tube.

SUMMARY

In one aspect, an end-cap of LED tube may include an end-cap housing, at least one elastic component, and a connecting assembly. The end-cap housing may include at least one power pin thereon and configured to connect to an external power source. The at least one elastic component may reside inside the end-cap housing. The end-cap housing may connect to a first end of the connecting assembly via an extendable connection and a second end of the connecting assembly opposite to the first end thereof connects to a body of the LED tube through a power connector. The power connector may be disconnected from the at least one power pin when the elastic component is pressed. The power connector may be connected to the at least one power pin when the elastic component is not pressed.

In some embodiments, the connecting assembly may include at least one screw and at least one groove inside the end-cap housing along a longitudinal axis of the LED tube. An upper half of the screw near a screw head of the at least one screw may have no screw thread. The at least one screw may reside inside the at least one groove. A bottom half of the at least one screw may fasten the end-cap housing onto the connecting assembly.

In some embodiments, the power connector may include an elastic cylindroid.

In some embodiments, the power connector may be retractable in a direction along the longitudinal axis of the LED tube, and a retracting range of the power connector may be between 1 mm and 10 mm approximately.

In some embodiments, the power connector may contain a spring therein.

In some embodiments, when the at least one elastic component is not pressed, a distance of separation between the power connector and the at least one power pin may be between 2 mm and 10 mm approximately.

In some embodiments, the at least one elastic component may include a spring.

In another aspect, an end-cap of an LED tube may include an end-cap housing, a first elastic component, a power connector, and a movable assembly. The movable assembly may include a power pin thereon and configured to connect to an external power source. The first elastic component may reside inside the end-cap housing. A first end of the movable assembly may connect to the end-cap housing. A second end of the movable assembly opposite to the first end thereof may connect to a body of the LED tube through the power connector. The power connector may be electrically disconnected from the power pin when the end-cap housing is pressed. The power connector may be electrically connected to the power pin when the end-cap housing is not pressed.

In some embodiments, the power connector may be retractable in a direction along a longitudinal axis of the LED tube. A retracting range of the power connector may be between 1 mm and 10 mm approximately.

In some embodiments, when the end-cap housing is pressed, a distance of separation between the power connector and the at least one power pin may be between 2 mm and 10 mm approximately.

In some embodiments, the first elastic component may include a spring.

In some embodiments, the end-cap may further include a base and a second elastic component. The first elastic component may be disposed on a first side of the base and the second elastic component may be disposed on a second side of the base opposite the first side of the base such that, when the first elastic component is compressed the second elastic component is not compressed and when the second elastic component is compressed the first elastic component is not compressed.

In some embodiments, the power connector may be disposed on the second side of the base and at least partially exposed.

In some embodiments, the movable assembly may further include an electrically-conductive member that is electrically connected to the power pin and traverses through the base from the first side to the second side of the base. The electrically-conductive member may be electrically disconnected from the power connector when the first elastic component is compressed. The electrically-conductive member may be electrically connected from the power connector when the first elastic component is not compressed.

In some embodiments, the movable assembly may further include a support member. The electrically-conductive member may protrude from support member in a direction opposite to a direction in which the power pin protrudes from the support member.

In some embodiments, the power connector may be generally ring shaped.

In some embodiments, the movable assembly may further include an electrically-conductive member that is electrically connected to the power pin and generally cup shaped. The electrically-conductive member may be electrically disconnected from the power connector when the first elastic component is compressed, and the electrically-conductive member may be electrically connected from the power connector when the first elastic component is not compressed.

The claims and advantages will be more readily appreciated as the inventive concept becomes better understood by reference to the following detailed description and the accompanying drawings showing exemplary embodiments, in which like reference symbols designate like parts. For clarity, various parts of the embodiments in the drawings are not drawn to scale.

BRIEF DESCRIPTION OF THE DRAWINGS

The accompanying drawings are included to aid further understanding of the present disclosure, and are incorporated in and constitute a part of the present disclosure. The drawings illustrate a select number of embodiments of the present disclosure and, together with the detailed description below, serve to explain the principles of the present disclosure. It is appreciable that the drawings are not necessarily in scale as some components may be shown to be out of proportion than the size in actual implementation in order to clearly illustrate the concept of the present disclosure.

DETAILED DESCRIPTION OF PREFERRED EMBODIMENTS

Overview

Various implementations of the present disclosure and related inventive concepts are described below. It should be acknowledged, however, that the present disclosure is not limited to any particular manner of implementation, and that the various embodiments discussed explicitly herein are primarily for purposes of illustration. For example, the various concepts discussed herein may be suitably implemented in a variety of LED tubes having different form factors and light output.

The present disclosure provides a new end-cap for the LED tube. It ensures that an LED tube is activated only when both end-caps of the LED tube are inserted into the linear fixture sockets, thus protecting the installer from electrical shock during installation. The present disclosure also eliminates the drawbacks of the previous approaches and increases the safety and usability of the LED tube equipped with the new end-cap.

Example Implementations

Figure 1:
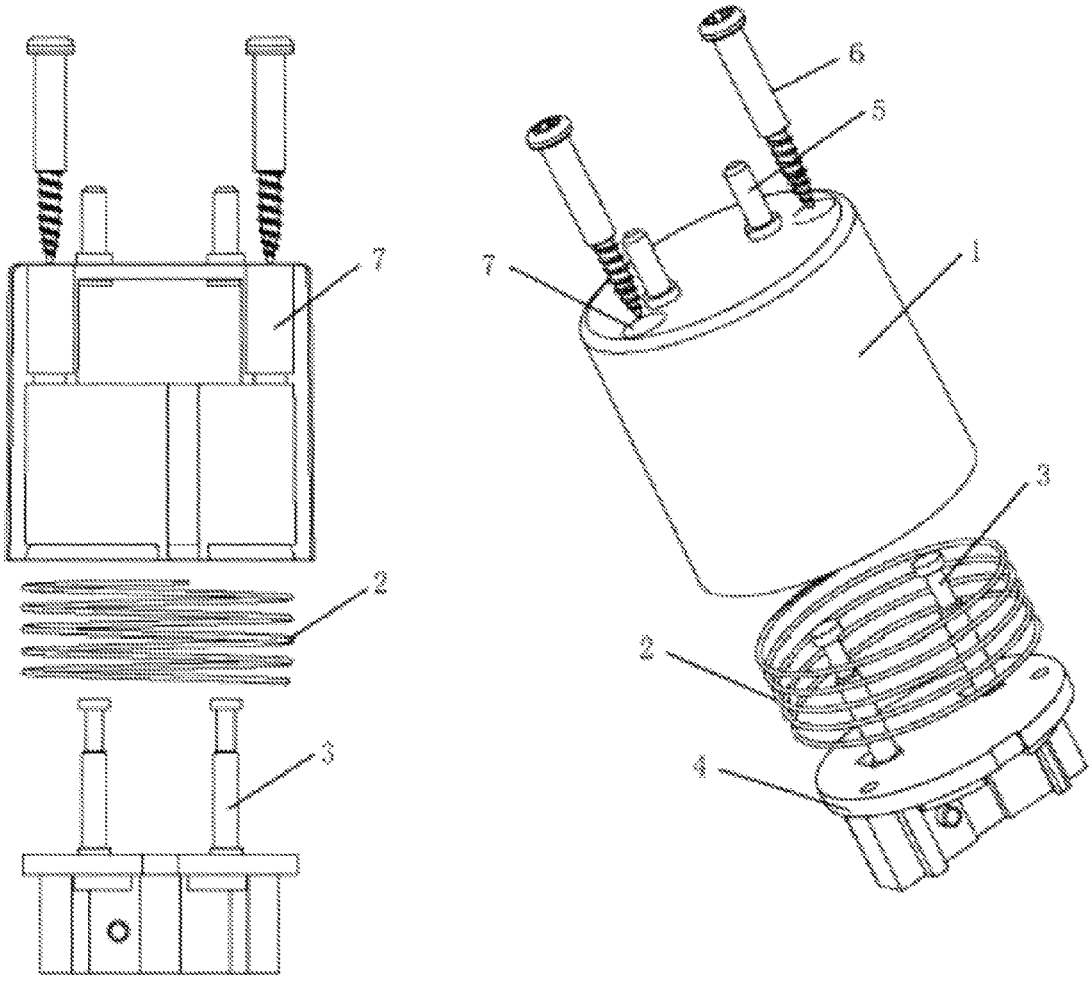
FIG. 1 schematically depicts an embodiment of the present disclosure.
Figure 2:
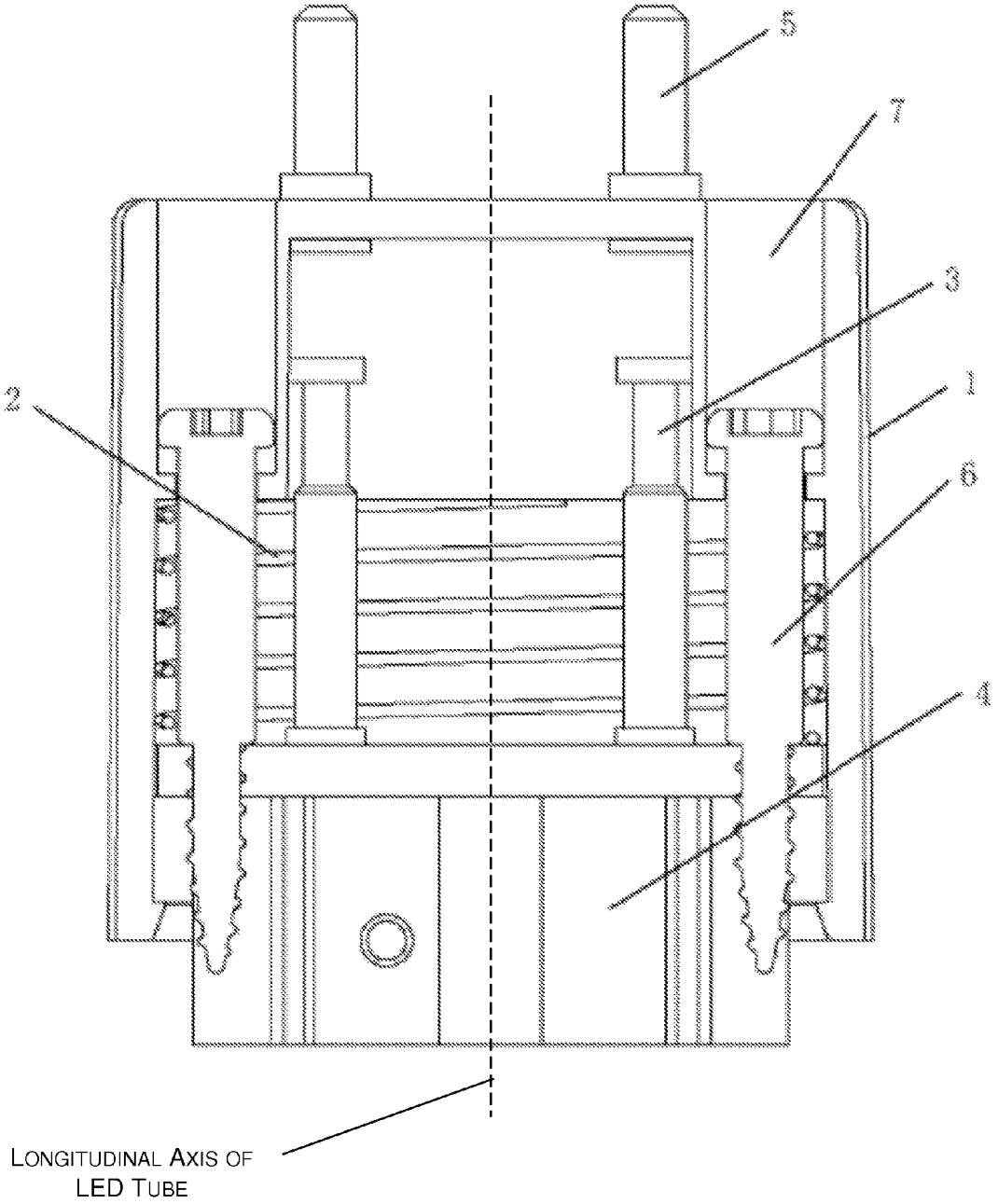
FIG. 2 schematically depicts the cross-section of an embodiment of the present disclosure when the end-cap housing is not pressed.

FIG. 1 illustrates one non-limiting example of an LED tube end-cap according to one embodiment of the present disclosure. The end-cap comprises of one end-cap housing 1, one elastic component 2 (e.g., a spring), and one connecting assembly 4. There are two pins 5 on the end-cap housing 1. The elastic component 2 resides inside the end-cap housing 1. The connecting assembly 4 includes two screws 6. On the upper half of the screw 6 near the screw head there is no screw thread. There are two grooves 7 inside the end-cap housing 1 along a longitudinal axis of the LED tube and the screws 6 reside inside the grooves 7. The bottom half of each screw 6 fastens the end-cap housing 1 onto the connecting assembly 4. When the end-cap housing 1 is pressed along the longitudinal axis of the LED tube, the end-cap housing 1 slides along the upper half of the screws 6 and moves in the direction of the longitudinal axis of the LED tube. There are two power connectors 3 at the bottom of the connecting assembly 4. When the elastic component 2 is pressed, the two power connectors 3 connect to the two pins 5 on the end-cap housing 1, and when the elastic component 2 is not pressed, the two power connectors 3 remain separate from the two pins 5, as shown in FIG. 2.

Figure 3:
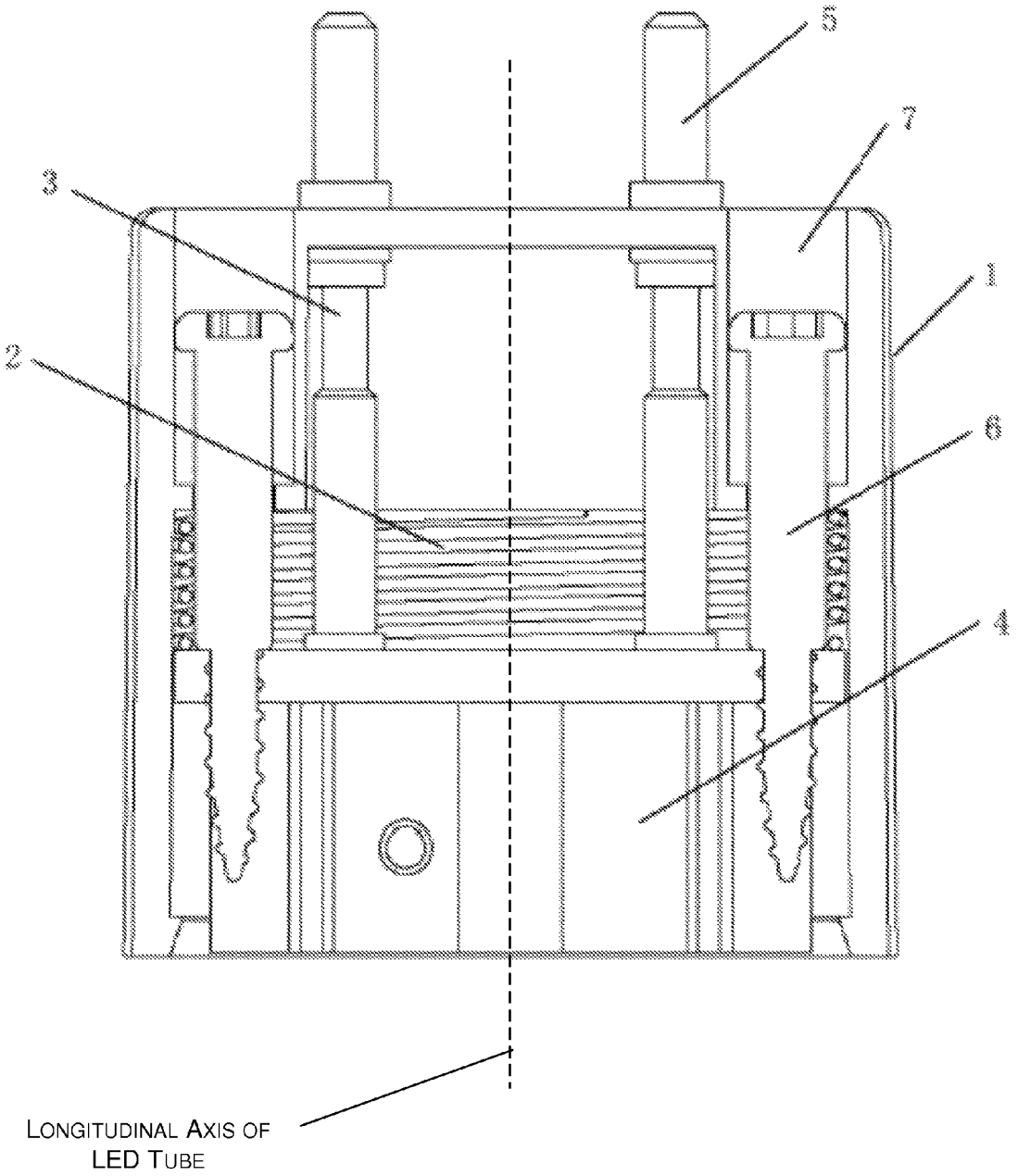
FIG. 3 schematically depicts the cross-section of an embodiment of the present disclosure when the end-cap housing is pressed.

In actual use, one side of the connecting assembly connects with the LED tube body. During the installation of an LED tube with the end-cap described in the present disclosure into a linear fixture, the end-cap housing 1 is pressed, thus causing the end-cap housing to slide along the longitudinal axis of the LED tube and press down on the elastic component 2. As a result, the two power connectors 3 connect to the two pins 5, as shown in FIG. 3. When the LED tube is taken out of the linear fixture, the pressure on the end-cap housing 1 is removed and the elastic component 2 pushes the end-cap 1 away from the LED tube, thus separating the two power connectors 3 from the two pins 5.

Figure 4:
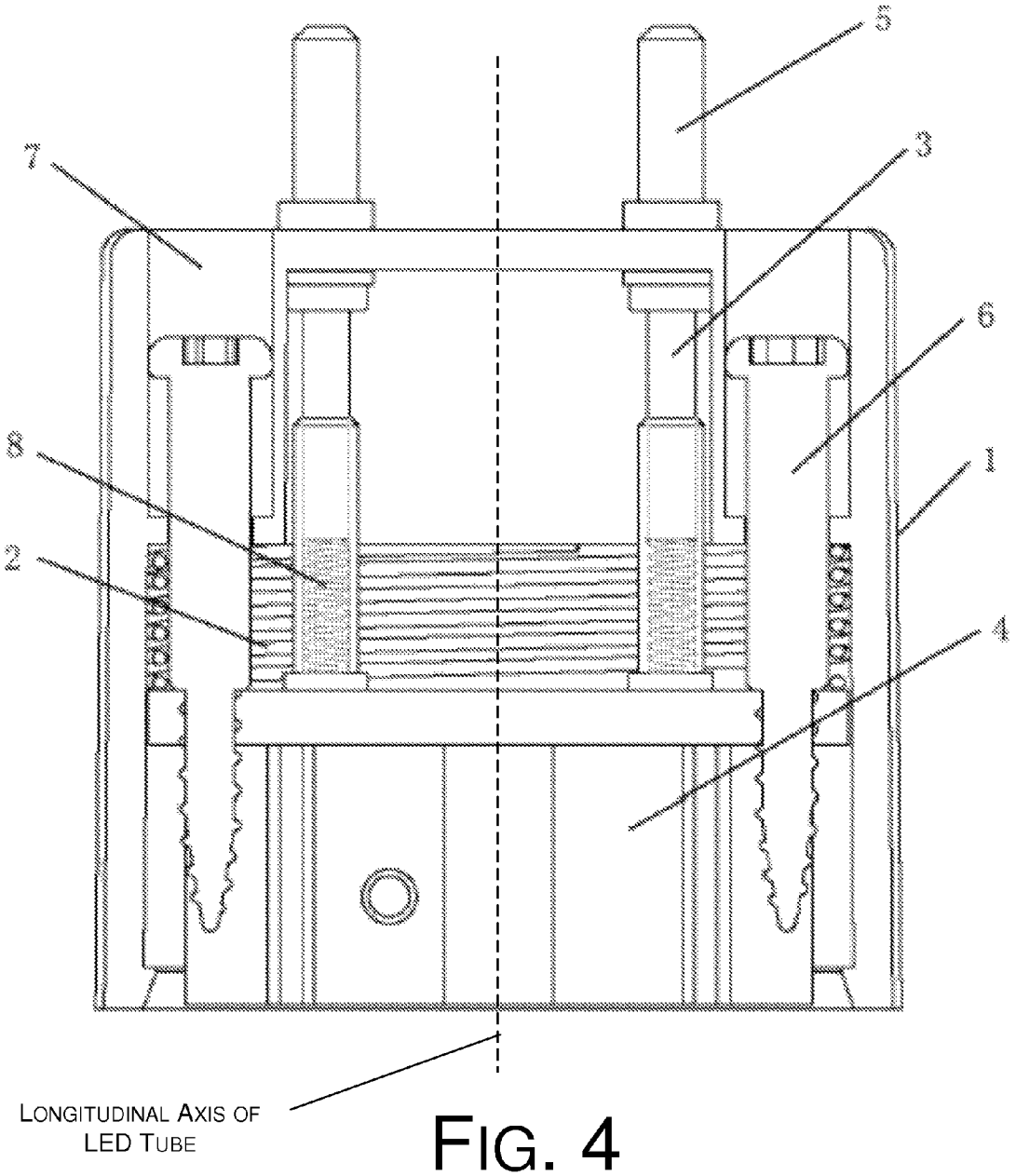
FIG. 4 schematically depicts the cross-section of another embodiment of the present disclosure when the end-cap housing is pressed, and the power connector contains a spring inside for adjusting the total length of the LED tube when the power connector is pressed.

FIG. 4 illustrates the cross-section of another embodiment of the present disclosure when the end-cap housing 1 is pressed. In addition to the components and structure shown in FIG. 1, the two power connectors 3 in FIG. 4 contain a spring 8 that has a 1-10 mm expansion range. After the end-cap housing 1 is pressed along the longitudinal axis of the LED tube until the two pins 5 connect to the two power connectors 3, additional pressure to the end-cap housing 1 causes the two power connectors 3 to retract between 1-10 mm along the longitudinal axis of the LED tube, resulting in an adjustment of the total length of the LED tube. This enables the installation of an LED tube into linear fixtures that vary slightly in length.

Figure 5A:
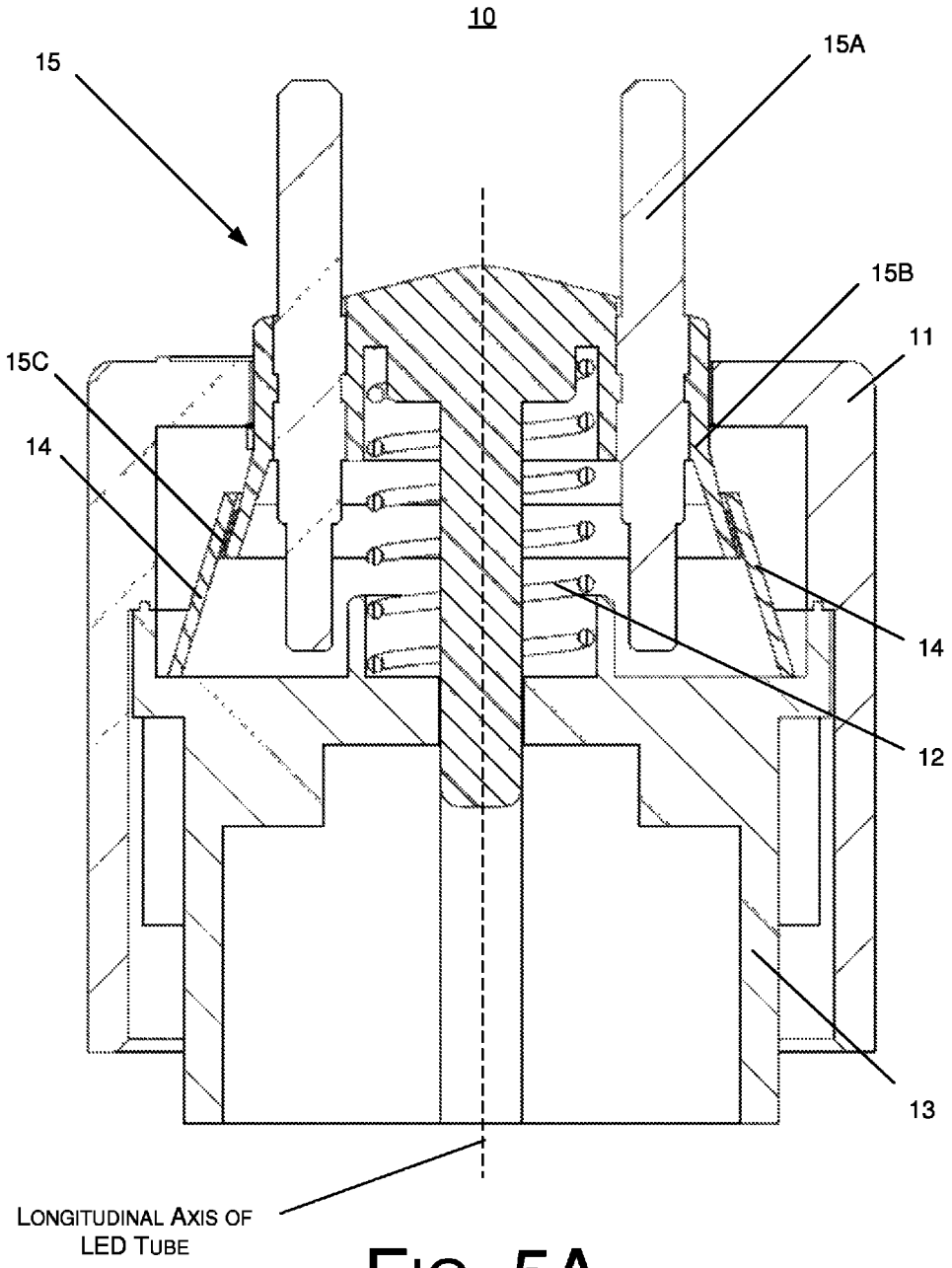
FIG. 5A schematically depicts the cross-section of yet another embodiment of the present disclosure when the end-cap housing is pressed.
Figure 5B:
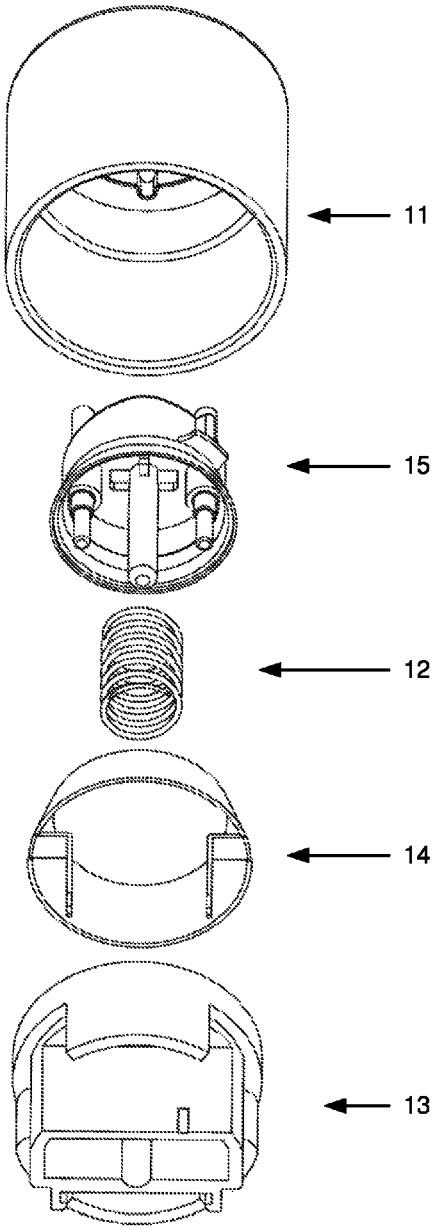
FIG. 5B shows a first exploded perspective view of the embodiment of FIG. 5A of the present disclosure.
Figure 5C:
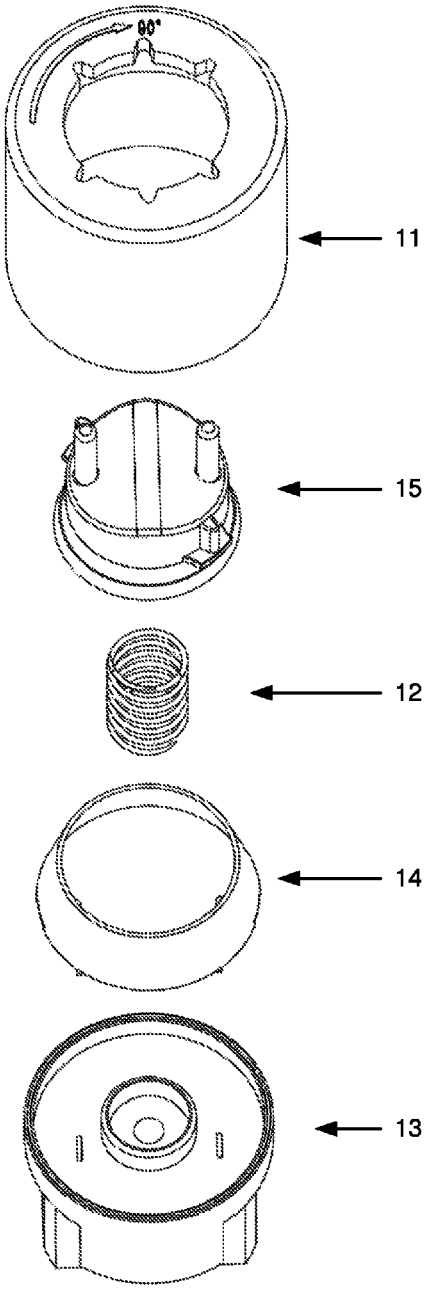
FIG. 5C shows a second exploded perspective view of the embodiment of FIG. 5A of the present disclosure.

FIG. 5A illustrates one non-limiting example of an LED tube end-cap 10 according to one embodiment of the present disclosure. FIG. 5B and FIG. 5C illustrate exploded perspective views of the LED tube end-cap 10 of FIG. 5A.

The end-cap 10 may be comprised of an end-cap housing 11, an elastic component 12 (e.g., a spring), a base 13, an electrically-conductive power connector 14, and a movable assembly 15. A first end of the movable assembly 15 may connect to the end-cap housing 11. A second end of the movable assembly 15 opposite to the first end thereof may connect to a body of the LED tube through the electrically-conductive power connector 14. Movable assembly 15 may include at least two power pins 15A, a support member 15B and an electrically-conductive member 15C. The power pins 15A may be electrically connected to the electrically-conductive member 15C. The support member 15B may support the power pins 15A, and the electrically-conductive member 15C may be disposed around a periphery of support member 15B. Support member 15B may comprise an elongated portion that traverses through base 13 from one side of base 13 to the opposite side of base 13. The elastic component 12 may reside inside the end-cap housing 11. The components may be arranged such that elastic component 12 may be disposed between the movable assembly 15 and base 13, with electrically-conductive power connector 14 disposed between movable assembly 15 and base 13.

Accordingly, movable assembly 15 may move along the longitudinal axis of the LED tube when pressed and not pressed. When movable assembly 15 of the end-cap housing 11 is pressed along the longitudinal axis of the LED tube, the end-cap housing 11 moves in the direction of the longitudinal axis of the LED tube. When the elastic component 12 is compressed as the end-cap housing 11 is pressed, the electrically-conductive power connector 14 is physically and electrically disconnected or separate from the electrically-conductive member 15C (and hence electrically disconnected from the power pins 15A) of movable assembly 15. When the elastic component 12 is not compressed as the end-cap housing 11 is not pressed, the electrically-conductive power connector 14 is physically and electrically connected to the electrically-conductive member 15C (and hence electrically connected to the power pins 15A) of movable assembly 15.

In some implementations, electrically-conductive power connector 14 may be generally ring shaped. Electrically-conductive member 15C of movable assembly 15 may be generally cup shaped.

In some implementations, the movable assembly 15 may be retractable in a direction along the longitudinal axis of the LED tube with a retracting range between 1 mm and 10 mm approximately. In some implementations, when the elastic component 12 is compressed, a distance of separation between the electrically-conductive power connector 14 and the electrically-conductive member 15C of movable assembly 15 may be between 2 mm and 10 mm approximately.

Figure 6A:
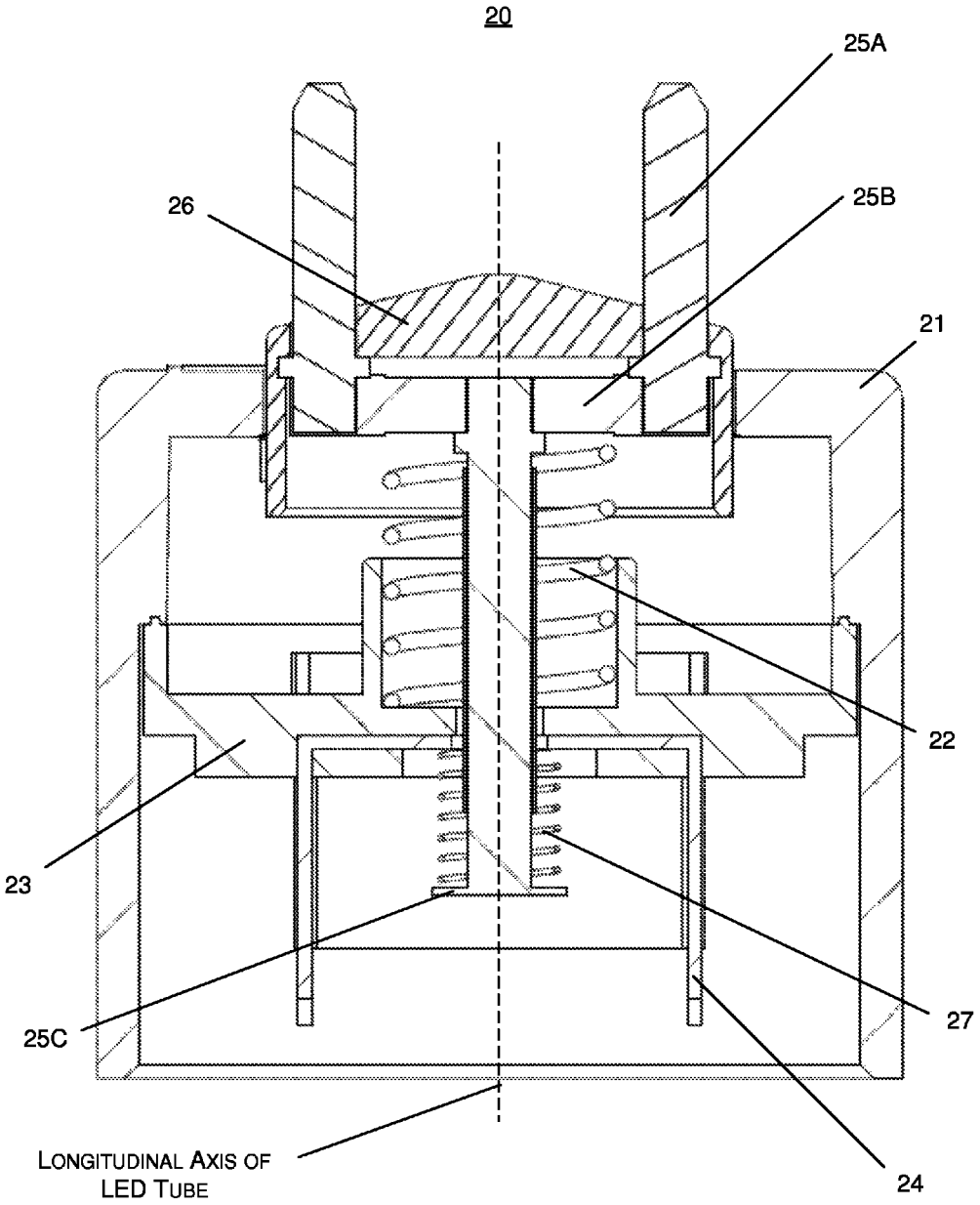
FIG. 6A schematically depicts the cross-section of still another embodiment of the present disclosure showing movement of the end-cap housing.
Figure 6B:
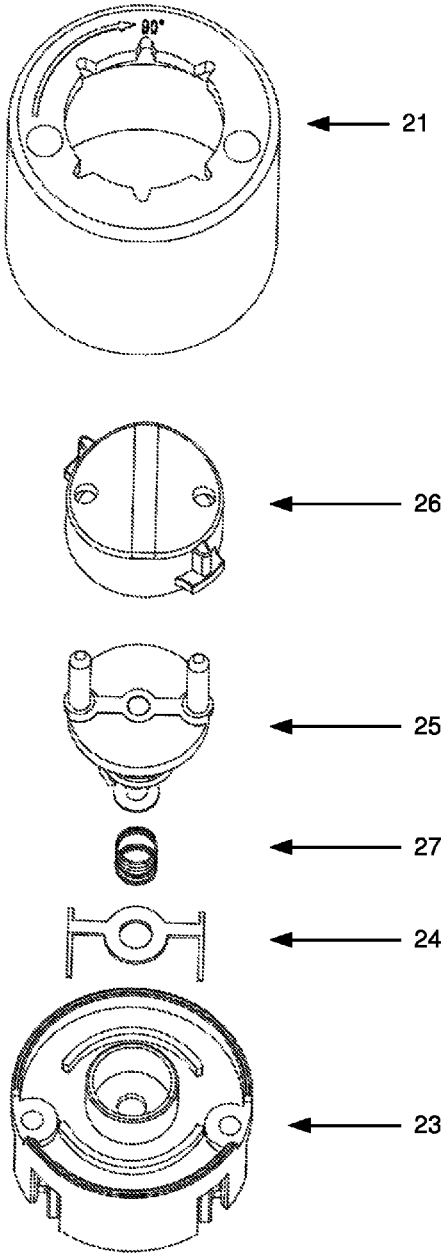
FIG. 6B shows an exploded perspective view of the embodiment of FIG. 6A of the present disclosure.
Figure 6C:
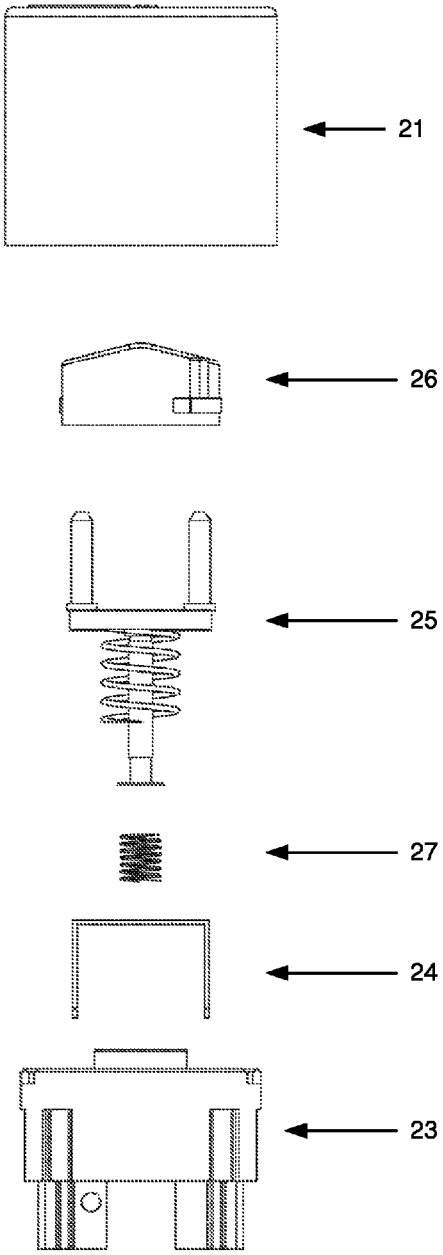
FIG. 6C shows an exploded side view of the embodiment of FIG. 6A of the present disclosure.

FIG. 6A illustrates another non-limiting example of an LED tube end-cap 20 according to one embodiment of the present disclosure. FIG. 6B and FIG. 6C illustrate different exploded perspective views of the LED tube end-cap 20 of FIG. 6A.

The end-cap 20 may be comprised of an end-cap housing 21, a first elastic component 22 (e.g., a spring), a base 23, an electrically-conductive power connector 24, a movable assembly 25, a cap 26 and a second elastic component 27 (e.g., a spring). A first end of the movable assembly 25 may connect to the end-cap housing 21. A second end of the movable assembly 25 opposite to the first end thereof may connect to a body of the LED tube through the electrically-conductive power connector 24. Movable assembly 25 may include at least two power pins 25A, a support member 25B (e.g., a printed circuit board) and an electrically-conductive member 25C. The power pins 25A may be electrically connected to the electrically-conductive member 25C. The support member 25B may support the power pins 25A, and the electrically-conductive member 25C may protrude from support member 25B in a direction opposite to a direction in which the power pins 25A protrude from the support member 25B. The first elastic component 22 may reside inside the end-cap housing 21. Cap 26 may be disposed on and around support member 25B with power pins 25A protruding through holes on cap 26. The components may be arranged such that first elastic component 22 may be disposed between the support member 25B and base 23 and that the second elastic component 27 may be disposed between the electrically-conductive member 25C and base 23, with the first elastic component 22 and the second elastic component 27 on opposite sides of the base 23. Electrically-conductive power connector 24 may be disposed on the side of base 23 facing electrically-conductive member 25C of movable assembly 25 with a portion of electrically-conductive power connector 24 exposed.

Accordingly, movable assembly 25 may move along the longitudinal axis of the LED tube when pressed and not pressed. When movable assembly 25 of the end-cap housing 21 is pressed along the longitudinal axis of the LED tube, the end-cap housing 21 moves in the direction of the longitudinal axis of the LED tube. When the first elastic component 22 is compressed (and the second elastic component 27 is stretched or otherwise not compressed) as the end-cap housing 21 is pressed, the electrically-conductive power connector 24 is physically and electrically disconnected or separate from the electrically-conductive member 25C (and hence electrically disconnected from power pins 25A) of movable assembly 25. When the first elastic component 22 is not compressed (and the second elastic component 27 is compressed) as the end-cap housing 21 is not pressed, the electrically-conductive power connector 24 is physically and electrically connected to the electrically-conductive member 25C (and hence electrically disconnected from the power pins 25A) of movable assembly 25.

In some implementations, the movable assembly 25 may be retractable in a direction along the longitudinal axis of the LED tube with a retracting range between 1 mm and 10 mm approximately. In some implementations, when the first elastic component 22 is compressed, a distance of separation between the electrically-conductive power connector 24 and the electrically-conductive member 25C of movable assembly 25 may be between 2 mm and 10 mm approximately.

While the present disclosure has been described and illustrated in its preferred embodiments, it should be understood that departure therefrom may be made within the scope of the present disclosure, which is not limited to the specific details disclosed herein.

Additional and Alternative Implementation Notes

Although the techniques have been described in language specific to certain applications, it is to be understood that the appended claims are not necessarily limited to the specific features or applications described herein. Rather, the specific features and examples are disclosed as non-limiting exemplary forms of implementing such techniques.

As used in this application, the term "or" is intended to mean an inclusive "or" rather than an exclusive "or." That is, unless specified otherwise or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more," unless specified otherwise or clear from context to be directed to a singular form.

For the purposes of this disclosure and the claims that follow, the terms "coupled" and "connected" may have been used to describe how various elements interface. Such described interfacing of various elements may be either direct or indirect.

What is claimed is:

1. An end-cap of a light-emitting diode (LED) tube, comprising:
- an end-cap housing;
- a first elastic component;
- a power connector; and
- a movable assembly, wherein:
  - the movable assembly comprises a power pin thereon and configured to connect to an external power source,
  - the first elastic component resides inside the end-cap housing,
  - a first end of the movable assembly connects to the end-cap housing, and
  - a second end of the movable assembly opposite to the first end thereof connects to a body of the LED tube through the power connector,
  - the power connector is electrically disconnected from the power pin when the end-cap housing is pressed, and
  - the power connector is electrically connected to the power pin when the end-cap housing is not pressed.

2. The end-cap of claim 1, wherein the power connector is retractable in a direction along a longitudinal axis of the LED tube, and wherein a retracting range of the power connector is between 1 mm and 10 mm approximately.

3. The end-cap of claim 1, wherein when the end-cap housing is pressed, a distance of separation between the power connector and the at least one power pin is between 2 mm and 10 mm approximately.

4. The end-cap of claim 1, wherein the first elastic component comprises a spring.

5. The end-cap of claim 1, further comprising:
- a base; and
- a second elastic component, wherein:
  - the first elastic component is disposed on a first side of the base and the second elastic component is disposed on a second side of the base opposite the first side of the base such that, when the first elastic component is compressed the second elastic component is not compressed and when the second elastic component is compressed the first elastic component is not compressed.

6. The end-cap of claim 5, wherein the power connector is disposed on the second side of the base and at least partially exposed.

7. The end-cap of claim 6, wherein the movable assembly further comprises an electrically-conductive member that is electrically connected to the power pin and traverses through the base from the first side to the second side of the base, wherein the electrically-conductive member is electrically disconnected from the power connector when the first elastic component is compressed, and wherein the electrically-conductive member is electrically connected from the power connector when the first elastic component is not compressed.

8. The end-cap of claim 7, wherein the movable assembly further comprises a support member, and wherein the electrically-conductive member protrudes from support member in a direction opposite to a direction in which the power pin protrudes from the support member.

9. The end-cap of claim 1, wherein the power connector is generally ring shaped.

10. The end-cap of claim 9, wherein the movable assembly further comprises an electrically-conductive member that is electrically connected to the power pin and generally cup shaped, wherein the electrically-conductive member is electrically disconnected from the power connector when the first elastic component is compressed, and wherein the electrically-conductive member is electrically connected from the power connector when the first elastic component is not compressed.

* * * * *